United States Patent [19]

Murata et al.

[11] Patent Number: 4,516,002

[45] Date of Patent: May 7, 1985

[54] CIRCUIT BREAKER WITH ARC LIGHT ABSORBER

[75] Inventors: Shirou Murata; Hajimu Yoshiyasu, both of Itami; Fumiyuki Hisatsune, Fukuyama; Shinji Yamagata, Fukuyama; Junichi Terachi, Fukuyama, all of Japan

[73] Assignee: Mitsubishi Denki Kabushiki Kaisha, Chiyodaku, Japan

[21] Appl. No.: 485,581

[22] Filed: Apr. 14, 1983

[30] Foreign Application Priority Data

Apr. 15, 1982 [JP] Japan ..... 57-64396
Apr. 15, 1982 [JP] Japan ..... 57-64397
Apr. 15, 1982 [JP] Japan ..... 57-64399

[51] Int. Cl.[3] ..... H01H 33/00
[52] U.S. Cl. ..... 200/144 C; 200/149 A
[58] Field of Search ..... 200/144 C, 148 G, 149 A

[56] References Cited

U.S. PATENT DOCUMENTS 2,864,919 12/1958 Stringfellow ..... 200/144 C
3,236,979 2/1966 Latour ..... 200/144 C
3,995,130 11/1976 Mauthe et al. ..... 200/148 G
4,436,831 3/1984 Nishizako et al. ..... 200/144 C

FOREIGN PATENT DOCUMENTS 54-57453 4/1979 Japan .
55-46487 4/1980 Japan .
56-112842 8/1981 Japan .
56-143635 11/1981 Japan .
56-176447 12/1981 Japan .
57-8118 2/1982 Japan .
57-45139 3/1982 Japan .
57-69605 4/1982 Japan .

*Primary Examiner*—Robert S. Macon
*Attorney, Agent, or Firm*—Wenderoth, Lind & Ponack

[57] ABSTRACT

The present invention relates to a circuit breaker with an arc light absorber comprising: a pair of contactors contained in an insulating container for opening or closing an electric circuit, electric conductors forming said electric contactors and contacts and arc runners provided at said conductors, and arc light absorbing side walls provided at both sides of said arc runners for absorbing the arc light energy irradiated directly to the arc produced between said contactors, said side walls being formed of a composite material having one or more of fiber, net or porous material having more than 35% of apparent porosity.

9 Claims, 20 Drawing Figures

CIRCUIT BREAKER WITH ARC LIGHT ABSORBER

BACKGROUND OF THE INVENTION

This invention relates to a circuit breaker in which pressure in a container of the breaker is suppressed. The circuit breaker in this invention generates an arc in a container, normally a small-sized container such as in a circuit breaker, a current limiter or an electromagnetic switch.

A prior art circuit breaker will be described below.

FIGS. 1A, 1B and 1C are sectional views showing a conventional circuit breaker in different operating states.

Numeral 1 designates a cover, and numeral 2 a base, which forms an insulating container 3 with the cover 2. Numeral 4 designates a stationary contactor, which has a stationary conductor 5 and a stationary contact 6 at one end of the conductor 5, and the other end of the conductor 5 becomes a terminal connected to an external conductor (not shown). Numeral 7 designates a movable contactor, which has a movable conductor 8 and a movable contact 9 disposed oppositely to the contact 6 at one end of the conductor 8. Numeral 10 designates a movable contactor unit, and numeral 11 a movable element arm, which is attached to a crossbar 12 so that each pole simultaneously opens or closes. Numeral 13 designates an arc extinguishing chamber in which arc extinguishing plates 14 are retained by side plates 15. Numeral 16 designates a toggle linkage, which has an upper link 17 and a lower link 18. The link 17 is connected at one end thereof to a cradle 19 through a shaft 20 at the other end thereof to one end of the link 18 through a shaft 21. The other end of the link 18 is connected to the arm 11 of the contactor unit 10. Numeral 22 designates a tiltable operating handle, and numeral 23 an operating spring, which is provided between the shaft 21 of the linkage 16 and the handle 22. Numerals 24 and 25 respectively designate a thermal tripping mechanism and an electromagnetic tripping mechanism, which are respectively provided to rotate a trip bar 28 counterclockwise via a bimetal 26 and a movable core 27. Numeral 29 designates a latch, which is engaged at one end thereof with the bar 28 and at the other end thereof with the cradle 19.

When the handle 22 is tilted down to the closing position in the state that the cradle 19 is engaged with the latch 29, the linkage 16 extends, so that the shaft 21 is engaged with the cradle 19, with the result that the contact 9 is brought into contact with the contact 6. This state is shown in FIG. 1A. When the handle 22 is then tilted down to the open position, the linkage 16 is bent to isolate the contact 9 from the contact 6, and the arm 11 is engaged with a cradle shaft 30. This state is shown in FIG. 1B. When an overcurrent flows in the circuit with the contacts in the closed state shown in FIG. 1A, the mechanism 24 or 25 operates, the engagement of the cradle 19 with the latch 29 is ended, the cradle 19 rotates clockwise around the shaft 30 as a center, and is abutted against a stop shaft 31. Since the connecting point of the cradle 19 and the link 17 is past the operating line of the spring 23, the linkage 16 is bent by the elastic force of the spring 23, each pole automatically cooperatively breaks the circuit via the bar 12. This state is shown in FIG. 1C.

The behavior of an arc which is generated when the circuit breaker breaks the current will be described below.

When the contact 9 is contacted with the contact 6, the electric power is supplied sequentially from a power supply side through the conductor 5, the contacts 6 and 9 and the conductor 8 to a load side. When a large current such as a shortcircuiting current flows in this circuit in this state, the contact 9 is separated from the contact 6 as described before. In this case, an arc 32 is generated between the contacts 6 and 9, and an arc voltage is produced between the contacts 6 and 9. Since this arc voltage rises as the distance from the contact 6 to the contact 9 increases and the arc 32 is urged by the magnetic force toward the plate 14 so as to be extended, the arc voltage is further raised. In this manner, an arc current approaches the current zero point, thereby extinguishing the arc to complete the breakage of the arc. The huge injected arc energy eventually becomes thermal energy, and is thus dissipated completely out of the container, but transiently raises the gas temperature in the limited space in the container and accordingly causes an abrupt increase in the gas pressure. This causes a deterioration in the insulation in the circuit breaker and an increase in the quantity of discharging spark escaping from the breaker, and it is thereby feared that an accident such as a power source shortcircuit or damage to the circuit breaker body will occur.

SUMMARY OF THE INVENTION

The present invention has overcome the disadvantages of the above-described prior art circuit breaker. More particularly, the present invention provides a novel circuit breaker with an arc light absorber based on the discovery by the present inventors of an arc phenomenon, and in which a pair of side walls forming an arc light absorber are provided corresponding to the positions of arc runners.

Figure 1:
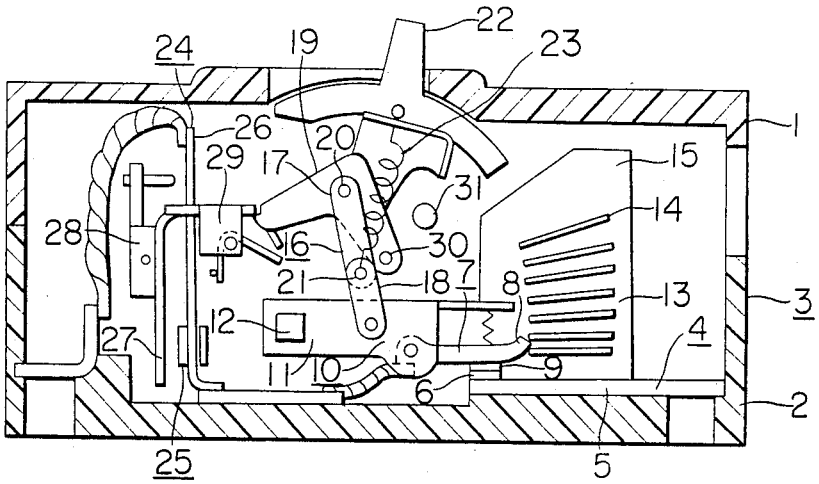
FIG. 1 (A) PRIOR ART
FIG. 1A is a fragmentary sectional front view showing the contact closed state of a prior art circuit breaker.
FIG. 1B is a fragmentary sectional front view showing the contact open state by the operation of an operating handle of the circuit breaker in FIG. 1A.
FIG. 1C is a fragmentary sectional front view showing the contact open state at the overcurrent operating time of the circuit breaker in FIG. 1A.
Figure 1:
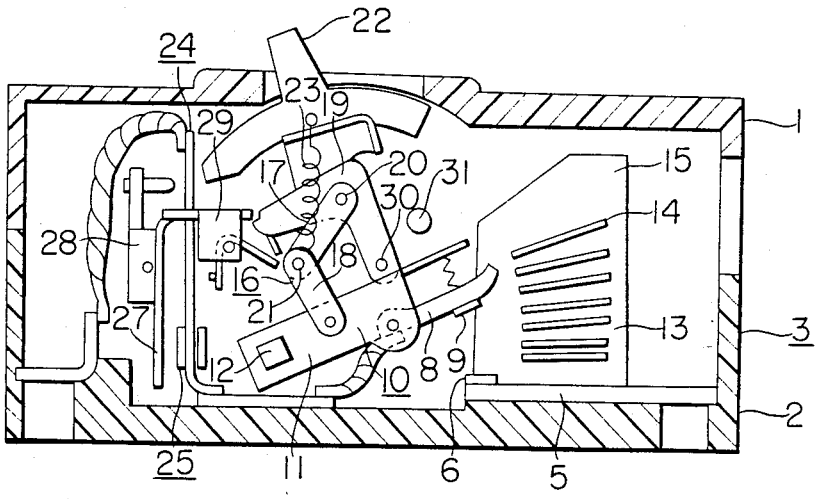
Figure 1C:
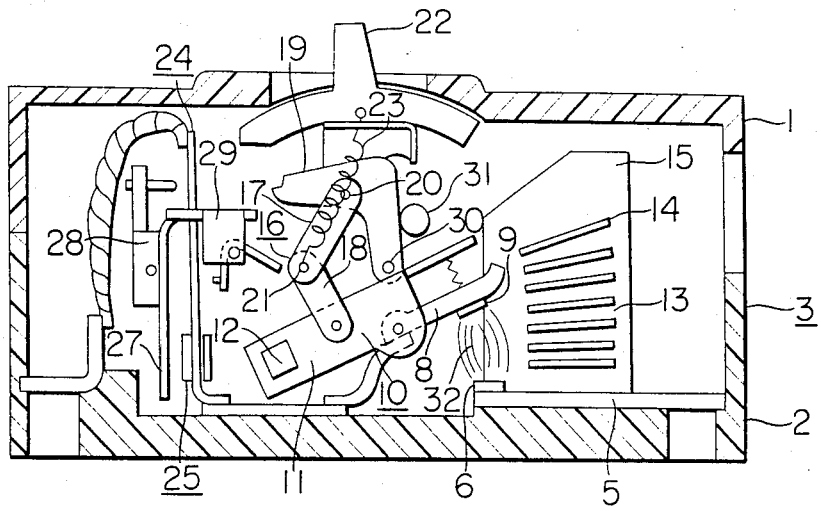

FIGS. A of FIGS. 7A to 12A are fragmentary sectional front views of circuit breakers with arc light absorbers showing embodiments of the present inventions; and FIGS. B of FIGS. 7B to 12B are fragmentary sectional plan views on the lines B—B in the respective FIGS. A of the above embodiments.

In the drawings, the same symbols indicate the same or corresponding parts.

DESCRIPTION OF THE PREFERRED EMBODIMENTS

A mechanism of an arc energy consumption based on the creation of the present invention will be first described below.

Figure 2:
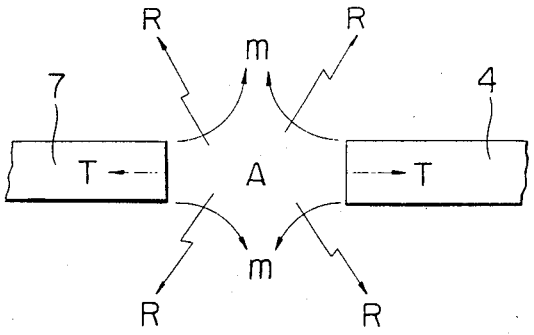
FIG. 2 is a view for explaining the flow of arc energy produced at the contactor opening time.

FIG. 2 is a view showing an arc A is produced between contactors 4 and 7. In FIG. 2, character T designates a flow of thermal energy which is dissipated from the arc A through the contactors, character m the flows of the energy of metallic particles which are released from the arc space, and character R the flows of energy caused by light which is irradiated from the arc space. In FIG. 2, the energy injected to the arc A is generally consumed by the flows T, m and R of the above three energies. The thermal energy T which is conducted to electrodes is extremely small, and most of the energy is carried away by the flows m and T. In the mechanism of the consumption of the energy of the arc A, it has theretofore been considered that the flows m in FIG. 2 are almost of the energies, and the energy of the flows R has been substantially ignored, but it has been found by the recent studies of the present inventors that the consumption of the energy by the flows R and hence the energy of light is so huge as to reach approximately 70% of the energy injected into the arc A.

In other words, the consumption of the energy injected into the arc A can be formulated as below.

$$P_W = V.I = P_K + Pth + P_R$$

$$P_K = \tfrac{1}{2} m V^2 + m.C_p T$$

where $P_W$: instantaneous injection energy

V: arc voltage

I: current

V.I: instantaneous electric energy injected into the arc $P_K$: quantity of instantaneous energy which is carried by the metallic particles $mv^2/2$: quantity of instantaneous energy carried away when the metallic particles of mg scatter at a speed v $m.C_p.T$: quantity of instantaneous energy carried away when the gas (the gas of the metallic particles) of constant-pressure specific head $C_P$ pth: quantity of instantaneous energy carried away from the arc space to the contactor via thermal conduction $P_R$: quantity of instantaneous energy irradiated directly from the arc via light The above quantities vary according to the shape of the contactors and the length of the arc. When the length of the arc is 10 to 20 mm, $P_K$=10 to 20%, Pth=5%, and $P_R$=75 to 85%.

Figure 3:
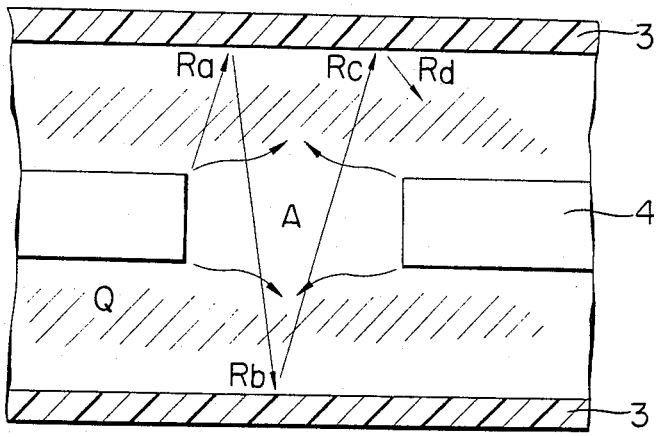
FIG. 3 is a view for explaining the state when the arc produced at the contactor opening time is enclosed in a container.

The state in which the arc A is enclosed in the container is shown in FIG. 3. When the arc A is enclosed in the container 3, the space in the container 3 is filled with the metallic particles and reaches a high temperature. The above state is strong particularly in the gas space Q (the space Q designated by shading lines in FIG. 3) around the periphery of an arc positive column A. The light irradiated from the arc A is irradiated from the arc positive column A to the wall of the container 3, and is reflected from the wall. The reflected light is scattered, is passed again through the high temperature space in which the metallic particles are present, and is again irradiated to the wall surface. Such courses are repeated until the quantity of light becomes zero. One path of the light reflected in this way is shown by Ra, Rb, Rc and Rd in FIG. 3.

The consumption of the light irradiated from the arc A is at the following two points in the above course.

(1) Absorption at the wall surface (2) Absorption in the arc space and peripheral (high temperature) gas space and hence by the gas space The light irradiated from the arc includes wavelengths from far ultraviolet less than 2000 Å to far infrared more than 1 μm and a wavelength range which is continous spectra and linear spectra. The wall surface of the general container has a light absorption capability only in the range of approximately 4000 Å to 5500 Å even if the surface is black, and partly absorbs in the other range, but mostly reflects. However, the absorptions in the arc space and the peripheral high temperature gas space become as described below.

When the light of wavelength λ is irradiated to the gas space having a length L, and uniform composition and temperature, the quantity of light absorption by the gas space can be calculated as below.

$$Ia = Ae.n.L.Iin \qquad (1)\ ps$$

where

Ia: absorption energy by gas

Ae: absorption probability

Iin: irradiated light energy n: particle density

L: length of light path of the light

However, the formula (1) represents the quantity of absorption energy for special wavelength λ. The Ae is the absorption probability for the special wavelength λ, and is a function of the wavelength λ, gas temperature and type of the particles.

In the formula (1), the absorption coefficient becomes the largest in gas of the same type as a light source gas for irradiating the same light (i.e., the type and the temperature of the particles are the same) in both the continuous spectra and the linear spectra according to the teaching of quantum mechanics. In other words, the arc space and the peripheral gas space absorb the most light irradiated from the arc space.

In the formula (1), the quantity Ia of the absorption energy of the light is proportional to the length L of the light path. As shown in FIG. 3, when the light from the arc space is reflected from the wall surface, the L in the formula (1) is increased by the number of times of reflections of the light, and the quantity of the light energy absorbed in the high temperature section of the arc space is increased.

This means that the energy of the light irradiated by the arc A is eventually absorbed by the gas in the container 3, thereby rising the gas temperature and accordingly the gas pressure.

It is the premise of the present invention that, in order to effectively absorb the energy of the light which reaches approximately 70% of the energy injected to the arc, a special material is used and one or more types of fiber, net and highly porous material having more than 35% of porosity for effectively absorbing the light irradiated from the arc are selectively disposed at a special position for receiving the energy of the light of the arc in the container of the circuit breaker, thereby absorbing a great deal of the light in the container so as to lower the temperature of the gas space and to lower the pressure.

The above-described fiber is selected from inorganic materials, metals, composite materials, woven materials and non-woven fabric, and it is necessary that it have thermal strength since it is installed in the space which is exposed to the high temperature arc.

The above-described net includes inorganic materials, metals, composite materials, and further superposed materials in multilayers of fine metal gauze, woven strands to be selected. In the case of the net, it is also necessary to have thermal strength.

Of the above-described materials of the fiber and the net, the inorganic materials includes ceramics, carbon, asbestos, and the optimum metals include Fe, Cu, and may include plated Zn or Ni.

The highly porous material is generally a material from among metals, inorganic materials and organic materials which have a number of fine holes in a solid structure, and are classified with regard to the relationship between the material and the fine holes into material which contains as a main body solid particles sintered and solidified at the contacting points therebetween and the material which contains in a main body holes in such a manner that partition walls forming the holes are solid material. In the present invention, the term blank means the material before being machined to a concrete shape, i.e. simply "a material".

When the materials of the blanks are further more specifically classified, the material can be classified into material in which the gaps among the particles exists as fine holes, material in which the gaps among the particles commonly exist as fine holes in the particles, and material which contains foamed holes therein. The materials are generally classified into material which has air permeability and water permeability, and material which has pores individually independent from each other without air permeability.

The shape of the above fine holes is very complicated, and is generally classified into open holes and closed holes, the structures of which are expressed by the volume of the fine holes or porosity, the diameter of the fine holes and the distribution of the diameters of the fine holes and specific surface area.

The true porosity is expressed by the volume of all the open and closed holes contained in the porous material relative to the total volume (bulk volume) of the material, i.e., percentage, which is measured by a substitution method and an absorption method with liquid or gas, but can be calculated as described below as defined in the method of measuring the specific weight and the porosity of a refractory heat insulating brick of JISR 2614 (Japanese Industrial Standard, the Ceramic Industry No. 2614).

$$\text{True porosity} = (1 - \frac{\text{Bulk specific weight}}{\text{True specific weight}} \times 100\%$$

The apparent porosity is expressed by the volume of the open holes with respect to the total volume (bulk volume) of the blank, i.e., percentage, which can be calculated as described below as defined by the method of measuring the apparent porosity, absorption rate and specific weight of a refractory heat insulating brick of JISR 2205 (Japanese Industrial Standard, the Ceramic Industry No. 2205). The apparent porosity may also be defined as an effective porosity.

$$\text{Apparent porosity} = \frac{\text{Water weight} - \text{dry weight}}{\text{Water weight} - \text{underwater weight}} \times 100\%$$

The diameter of the fine holes is obtained by the measured values of the volume of the fine holes and the specific surface area, and includes several Å (Angstrom) to several mm from the size near the size of an atom or ion to the boundary gap of the particle group, which is generally defined as the mean value of the distribution. The diameter of the fine holes of the porous blank can be obtained by measuring the shape, size and distribution of the pores with a microscope, by a mercury press-fitting method. In order to accurately know the shape of the composite pores and the state of the distribution of the pores, it is generally perferable to employ a microscope as a direct method.

The measurement of the specific surface area is performed frequently by a BET method which obtains the result by utilizing adsorption isothermal lines at the respective temperatures of various adsorptive gases, and nitrogen gas is frequently used.

The patterns of the absorption of the energy of the light and the decrease of the gas pressure by the absorption with the special material according to the present invention will be described for an example of an inorganic porous material.

Figure 4:
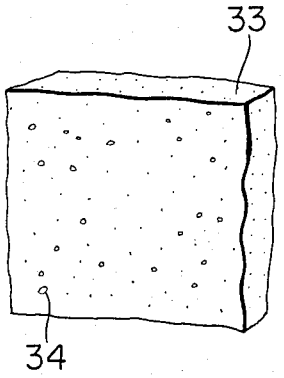
FIG. 4 is a perspective view showing an inorganic porous material necessary to form an arc light absorber.
Figure 5:
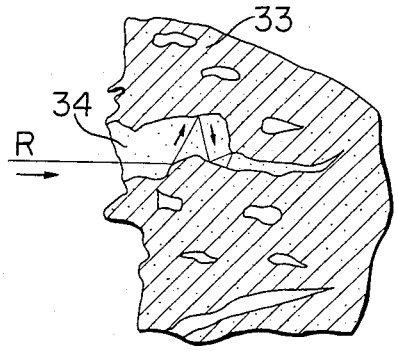
FIG. 5 is a fragmentary sectional view on an enlarged scale of a part of the material in FIG. 4.

FIG. 4 is a perspective view showing an inorganic porous blank, and FIG. 5 is an enlarged fragmentary sectional view of FIG. 4. In FIGS. 4 and 5, numeral 33 designates an inorganic porous blank, and numeral 34 the open holes communicating with the surface of the blank. The diameters of the hole 34 are distributed in the range from several microns to several mm in various manners.

When the light is incident to the hole 34 when the light is incident to the blank 33 as designated by R in FIG. 5, the light is irradiated onto the wall surface of the blank, is then reflected from the wall surface, is reflected in multiple ways in the hole, and is eventually absorbed 100% by the wall surface. In other words, the light incident to the hole 34 is absorbed directly in the surface of the blank, and becomes heat in the hole.

Figure 6:
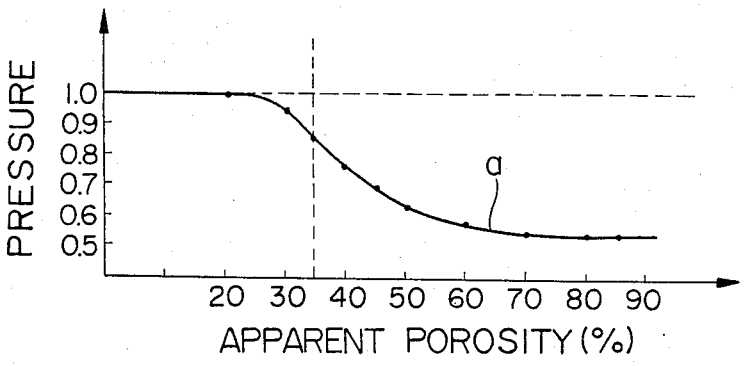
FIG. 6 is a characteristic curve diagram for showing the relationship between the apparent porosity of the inorganic porous material and the pressure in the container for containing the material.

FIG. 6 shows a characteristic curve diagram of the variation in the pressure in the model container in which the inorganic porous material is placed when the apparent porosity of the material is varied. In FIG. 6, the abscissa is the apparent porosity, and the ordinate expresses the pressure relative to a pressure of 1 as a reference when the porosity is 0 when the inner wall of the container is formed of metal such as Cu, Fe or Al. In the experiment AgW contacts were installed at a predetermined gap of 10 mm in a sealed cubic container with a side edge of 10 cm, an arc from a sinusoidal current of 10 kA at the peak was produced for 8 msec, and the pressure in the container produced by the energy of the arc was measured.

The inorganic porous materials used in the above embodiment were pieces of porous porcelain 50 mm×50 mm×4 mm prepared by forming and sintering a raw material of porcelain of cordierite to which was added an inflammable or foaming agent to form the porous material, which had fine holes with a mean diameter in the range of 10 to 300 microns and respective apparent porosities of 20, 30, 35, 40, 45, 50, 60, 70, 80 and 85%. These pieces were disposed on the wall surface of the container to cover 50% of the surface area of the inner surface of the container.

With respect to the diameter of the fine holes, a mean diameter which slightly exceeds the range of the wavelengths of the light to be absorbed and the rate of the fine holes occupying the surface, i.e., the degree of the specific surface area of the fine holes, become important. In the absorption of the light in the fine holes, the deep holes are more effective, and communicating pores are preferable. Since the light irradiated by the arc A has wavelengths distributed in the range of several hundreds Å to 10000 Å (1 μm), fine holes of several thousands Å to several 1000 μm mean diameter, which slightly exceeds the above wavelengths, are adequate, and a highly porous material has an apparent porosity which exceeds 35% in the area of the holes occupying the surface is useful for absorbing the light irradiated from the arc A. The effect can be particularly improved when the upper limit of the diameter of the fine holes is in the range less than 1000 μm and the specific surface area of the fine holes is larger. According to the experiments, it is confirmed that preferred absorbing characteristic can be obtained for the light irradiated from the arc by a material having a range of mean diameters of the fine holes from 5 μm to 1 mm. It is also observed that a glass material having 5 or 20 μm holes absorbs the light irradiated from the arc A very well.

As seen from the characteristic curve a in FIG. 6, the pores of the inorganic porous material absorb the light energy, and act to lower the pressure in the circuit breaker, which effect increases as the apparent porosity of the porous blank is increased, and increases remarkably as the porosity becomes larger than 35%, and which increases in the range up to 85%. When the porosity is further increased, it is necessary to further increase the thickness of the porous material.

When the porosity is increased, the relationship between the apparent porosity and the mechanical strength of the porous blank becomes such that the material becomes brittle, the thermal conductivity of the material decreases, and the material becomes readily fusible by the high heat. When the porosity is decreased, the effect of reducing the pressure in the circuit breaker is reduced. Accordingly, the optimum apparent porosity of the porous blank in practical use is in the range of 40 to 70%.

The characteristic trend of FIG. 6 can also be applied to the general inorganic porous materials, and this can be assumed from the above description as to the absorption of the light.

Some prior art circuit breakers use inorganic material, but its object is mainly to protect the organic material container against the arc A, and the necessary characteristics include arc resistance, lifetime, thermal conduction, mechanical strength, insulation and carbonization resistance. An inorganic material which satisfied these characteristics is composed of a material which has a tendency toward low porosity, and the object is different from the object of the present invention, and the apparent porosity of the prior art material is approximately 20%.

The highly porous materials are inorganic, metallic and organic materials, and the inorganic materials are particularly characterized as insulating and the high melting point material. These two characteristics are needed for the material to be installed in the container of the circuit breaker. In other words, since the material is electrically insulating, which does not have an adverse influence on the breakage, and since the material has a high melting point, the material does not become molten nor produce gas, even if the material is exposed to high temperature, and the material is optimum as the pressure suppressing material.

The inorganic porous materials can be porous porcelain, refractory material, glass, and cured cement, all of which can be used to decrease the gas pressure in the circuit breaker. The porous materials of the organic type have problems with respect to the heat resistance and gas production, the porous materials of the metal type have problems with respect to the insulation and pressure resistance, and are respectively limited in the places where they can be used.

In the circuit breaker in which arc runners are respectively provided on the conductors 5 and 8, an arc produced at the contacts upon opening of the contacts is transferred to the arc runners, and hence the end sides of the arc runners via magnetic force and the arc is elongated. Since this arc has huge energy, the arc raises the temperature of the gas in the container, thereby widely dissociating the ionizing the gas and accelerating the increase in the gas becoming conductive in the container. As a result, the arc is transferred to the arc runners, is elongated, and a becomes higher voltage arc. Since this high voltage arc tends to have a lower stable voltage and the gas becoming conductive at high temperature fills the container, the arc reversely returns to the contacts, thereby decreasing the arc voltage. This greatly reduces the breaking performance of the circuit breaker.

The present invention contemplates to eliminate the above-described problems of the prior art circuit breaker.

Embodiments of the present invention will now be described with reference to the accompanying drawings.

Figure 7A:
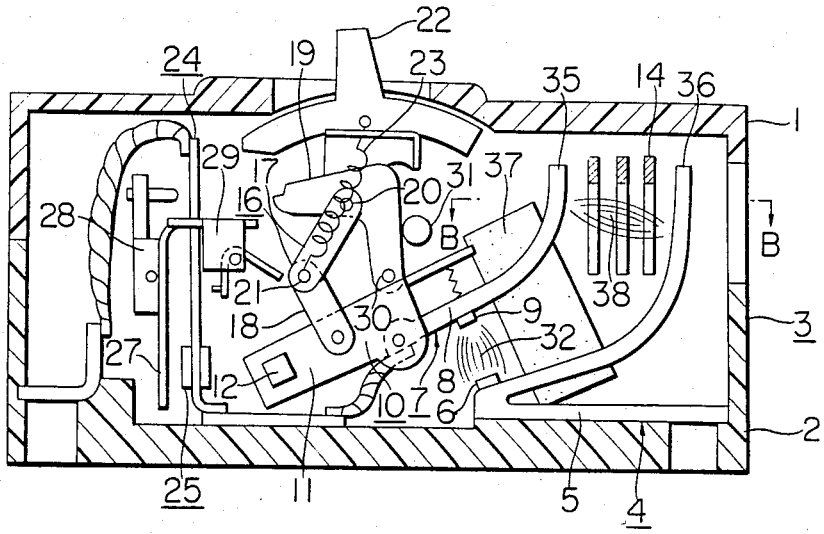
Figure 7B:
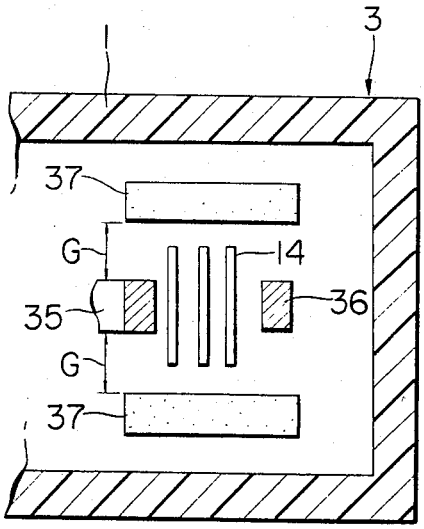

FIGS. 7A and 7B show an embodiment of the circuit breaker, to which the present invention is applied, wherein the like or corresponding parts to those in FIG. 1 are denoted by the same symbols as those in FIG. 1, and the description of which will not be repreated.

In FIGS. 7A and 7B, numerals 35 and 36 indicate arc runners extending from the ends of stationary and movable conductors 5 and 8. Side walls 37 forming an arc light absorber are provided at distances G laterally on both sides of the respective runners 35 and 36. The side walls 37 are formed of an inorganic porous material having more than 35% apparent porosity as described above.

In FIGS. 7A and 7B, numeral 32 indicates an arc which is produced between the contacts 6 and 9 at the initial time of opening the contacts, and numeral 38 an arc transferred to the ends of the runners 35 and 36 by being transferred along the runners 35 and 36 by the magnetic force.

The operation of the above embodiment thus constructed as described above will be described.

When the arc 32 is produced between the contacts 6 and 9, the vicinity of the arc 32 reaches a high temperature, and is temporarily filled with conductive gas. Since the light energy irradiated from the arc 32 is, however, substantially absorbed by the side walls 37 which are formed of an inorganic porous material and the absorption in the arc space due to the reflected light is eliminated, the temperature of the arc space is not raised higher. Therefore, when the arc 32 is transferred to the ends of the arc runners 35 and 36, the gas temperature in the vicinity of the arc 32 is containuously decreased, with the result that the conductive gas is accordingly continuously reduced. In other words, when the arc 32 is driven to the ends of the arc runners 35 and 36 to become the arc 38, the light energy irradiated from the arc 38 is absorbed by the side walls 37, thereby eliminating the temperature rise in the vicinity of the contacts 6 and 9. Accordingly, the temperature in the vicinities of the contacts 6 and 9 in which the arc 32 exists is lowered, and the conductive gas is almost all eliminated. Consequently, no rearcing occurs in the vicinities of the contacts 6 and 9.

Figure 8A:
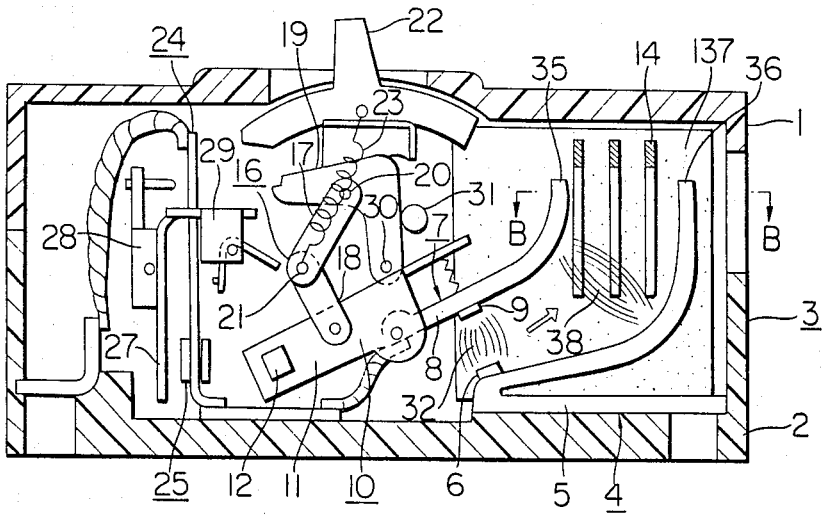
Figure 8B:
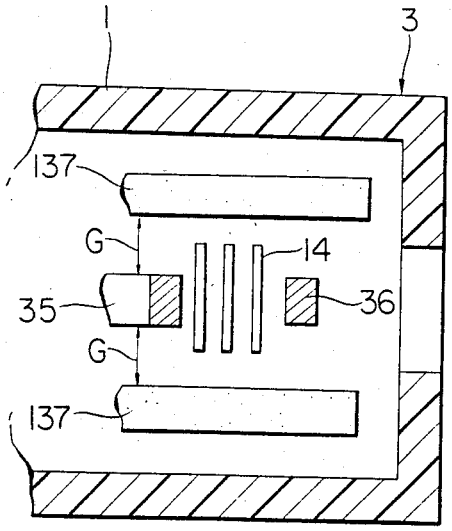

In the embodiment described above, the side walls 37 which are formed of the inorganic porous material are disposed between the runners 35 and 36, and the inner wall of the container 3. However, as shown in FIGS. 8A and 8B, side walls 137 are provided which extend from the sides of the contacts 6 and 9 past the arc extinguishing plates 14, and hence the area of the side walls extends over the positions at which the arc 32 is generated and is displaced, in which case the light energy irradiated from the arcs 32 and 38 can be absorbed over a wide range, and hardly any insulation breakdown occurs, with the result that the functions of the arc runners 35 and 36 can be further effectively performed.

Figure 9A:
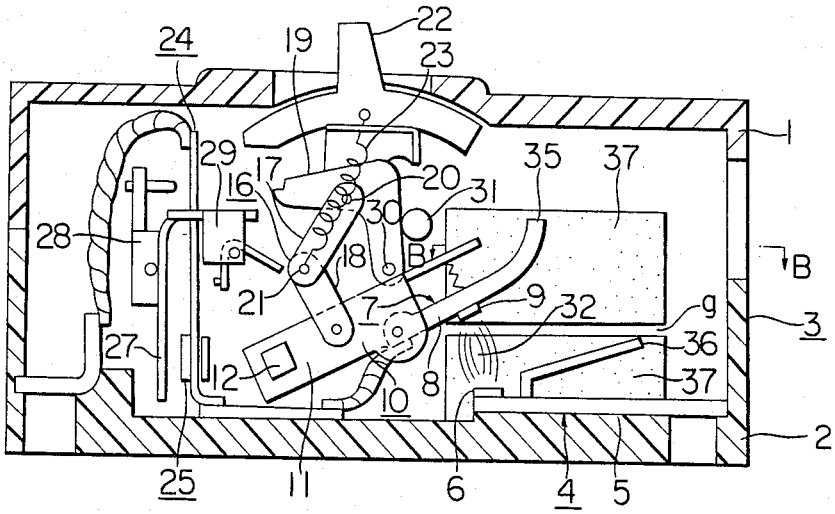
Figure 9B:
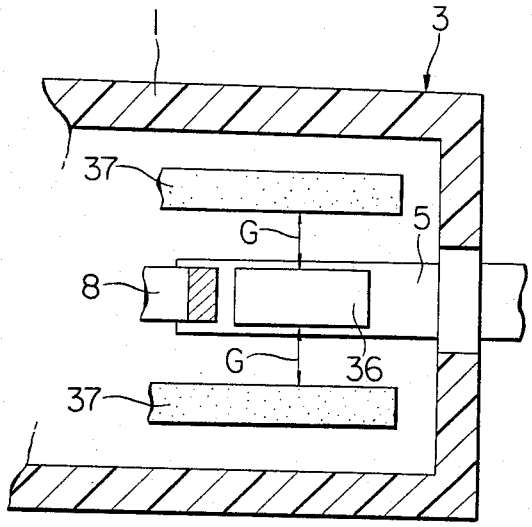

FIGS. 9A and 9B show still another embodiment of the present invention. In this embodiment, the side walls 37 have a horizontal gap g between the position corresponding to the bottom of arc runner 35 and the position corresponding to the top of arc runner 36, thereby improving the gas flow from the arc 32 without loss of the effect of absorbing the light. In this case, the local pressure rise can be alleviated, and cracks in the side walls 37 which are formed of an inorganic porous material can be further prevented.

Figure 10A:
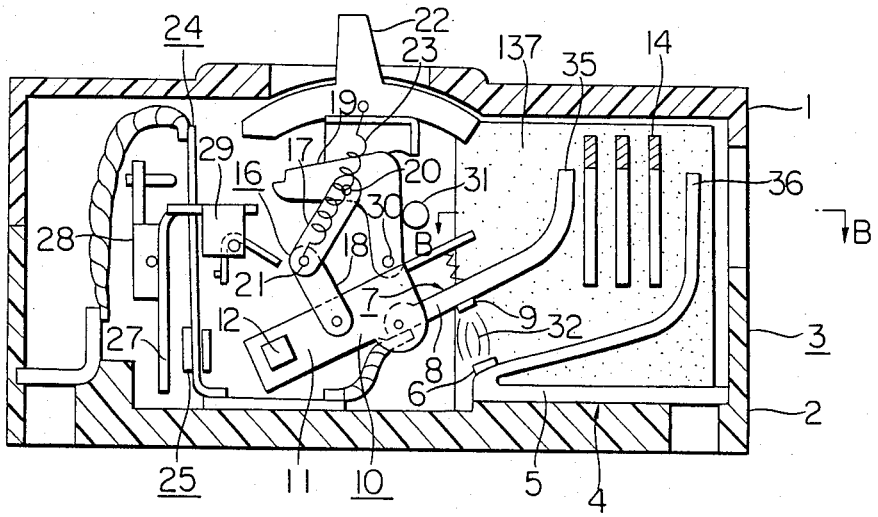
Figure 10B:
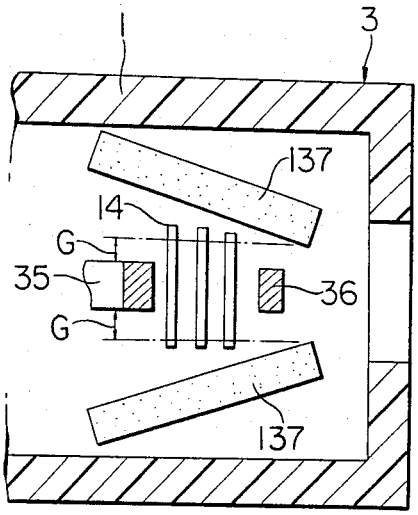
Figure 11A:
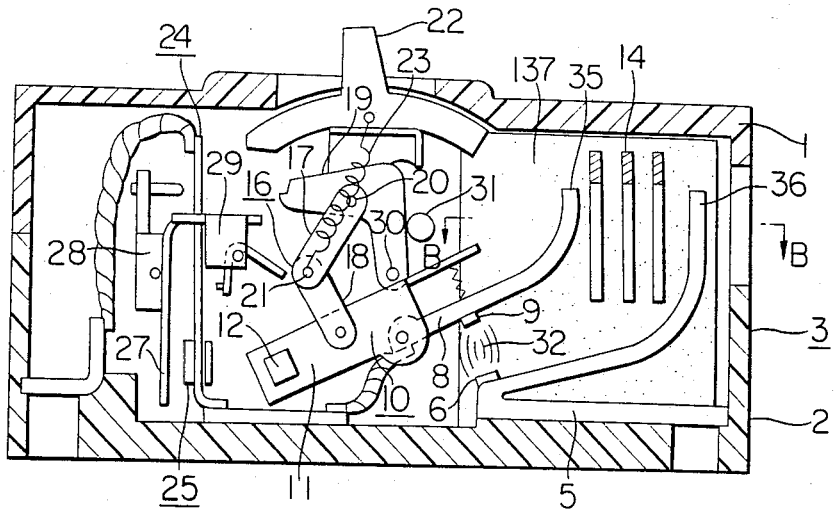
Figure 11B:
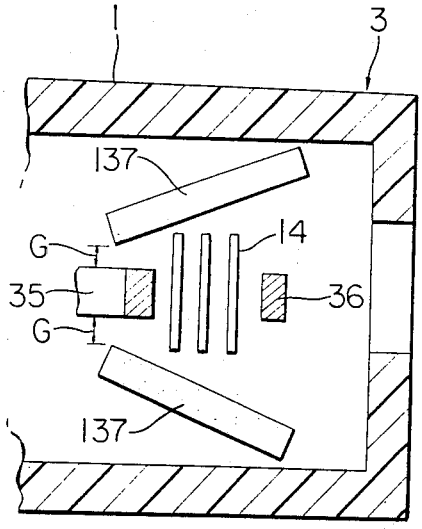

In the respective embodiments described above, the side walls 37 are parallel with the operating planes of electric contactors 4 and 7 in the opening and closing operations. As shown in FIGS. 10A and 10B, side walls 137 are disposed in a V-shape with the narrow end toward the forward direction of the moving direction of the arc 32, or as shown in FIGS. 11A and 11B, the side walls 137 are disposed in an inverted V-shape relative to FIGS. 10A and 10B, thereby achieving the same advantages as the embodiment shown in FIGS. 9A and 9B.

In the embodiments described above, the side walls 137 are formed of the inorganic porous material which has more than 35% apparent porosity. However, the side walls 137 may also be formed of other porous material other than inorganic material, for example fiber or net, or may be formed of a composite material having more than two types of the porous materials having the above special porosity.

According to the present invention as described above, the side walls which are formed of the special material capable of absorbing the light energy irradiated from the arc are provided between the arc runners and the side wall of the container, thereby suppressing the internal pressure in the container and recovering the insulation rapidly after the arc is transferred in the space charged with the conductivity due to the production of the arc. Thus, the original function of the arc runners can be sufficiently performed, driving the arc and accordingly improving the breaking performance in the circuit breaker.

Figure 12A:
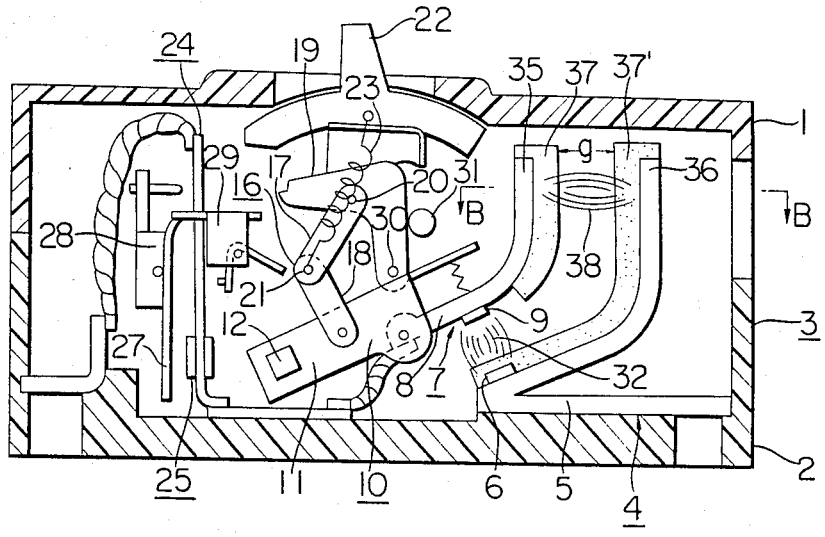
Figure 12B:
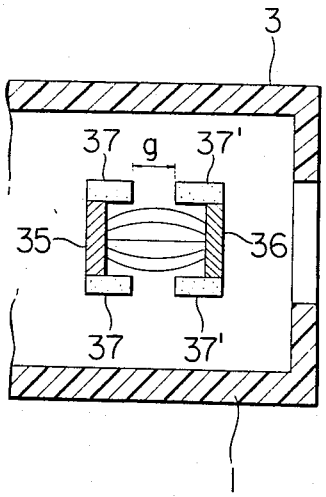

FIGS. 12A and 12B show a modified embodiment of the circuit breaker shown in FIGS. 9A and 9B. In FIGS. 12A and 12B, numerals 35 and 36 designate arc runners which extend from the end of stationary and movable conductors 5 and 8, respectively, and side walls 37 and 37' are provided in intimate contact with the outer lateral side surfaces of the runners 35 and 36 as shown in FIG. 12B, and have the edges spaced from each other a distance g. The side walls 37 and 37' are formed of an inorganic porous material having more than 35% apparent porosity as described above.

In FIGS. 12A and 12B, numeral 32 indicates an arc produced between the contacts 6 and 9 at the initial time of opening the contacts, numeral 38 an arc which is transferred by the drive force of the magnetic field to the arc runners 35 and 36 and to the ends of the runners 35 and 36.

The arcs 32 and 38 are in contact with the side walls 37 and 37' formed of the inorganic porous material on the outer side surfaces of the arc runners 35 and 36 only in the range surrounded by the runners 35 and 36 and the side walls 37 and 37', and the arcs 32 and 38 effectively move on the runners 35 and 36, respectively. Accordingly, the light energy from the arcs 32 and 28 is absorbed by the side walls 37 and 37' which are formed of the inorganic porous material, thereby suppressing the internal pressure, and since the increase in the arcs 32 and 38 is suppressed, the danger of melting and breaking of the container 3, the movable contactor unit 10 and the linkage 16 can be avoided. Further, since the gap g is formed between the side walls 37 and 37', the gas flow due to the arc can be improved, thereby making the opening of the contacts effective.

What is claimed is:

1. A circuit breaker with an arc light absorber comprising:

a pair of contactors contained in an insulating container for opening or closing an electric circuit;

electric conductors extending to said electric contactors and contacts and arc runners extending from said conductors away from said contactors; and arc light absorbing side walls provided on both sides of said arc runners for absorbing the arc light energy irradiated directly from the arc produced between said contactors when said contactors open;

said side walls being formed of a heat resistant, electrically insulating, light absorbing material having more than 35% apparent porosity.

2. A circuit breaker with an arc light absorber according to claim 1, wherein said side walls are formed of an inorganic porous material, which has 40% to 70% apparent porosity.

3. A circuit breaker with an arc light absorber according to claim 2, wherein said inorganic porous material is selected from the group consisting of porous porcelain, porous refractory material, porous glass and porous cured cement.

4. A circuit breaker with an arc light absorber accordingly to claims 2, wherein said inorganic porous material has fine holes with mean diameters of from several thousands Å to several 1000 μm.

5. A circuit breaker with an arc light absorber according to claim 2, wherein said side walls are parallel and spaced from the outer side surfaces of said arc runners.

6. A circuit breaker with an arc light absorber according to claim 1, wherein said side walls are arranged obliquely in a V-shape and spaced from the outer side surfaces of said arc runners.

7. A circuit breaker with an arc light absorber according to claim 3, wherein said inorganic porous material comprises several thousands A to several 1000 $\mu$m of mean diameter of fine holes.

8. A circuit breaker with an arc light absorber according to claim 1, wherein said side walls are in intimate contact with the outer side surfaces of said arc runners, and the edges of said side walls along the one arc runner are in spaced opposed relation to the edges of the side walls along the other arc runner.

9. A circuit breaker as claimed in claim 1, in which said contactors move relatively vertically and each of said walls has a horizontal gap therein intermediate the height of said walls, and said gap is above the upper end of the arc runner of the lower contactor and below the lower end of the arc runner of the upper contactor.

* * * * *